US011224821B2

(12) United States Patent
Rosen et al.

(10) Patent No.: US 11,224,821 B2
(45) Date of Patent: Jan. 18, 2022

(54) SHELL-WITHIN-A-SHELL MAGNETIC TOY CONSTRUCTION BLOCK

(71) Applicant: LaRose Industries, LLC, Randolph, NJ (US)

(72) Inventors: Lawrence Rosen, Aventura, FL (US); Parviz Daftari, Summit, NJ (US)

(73) Assignee: LAROSE INDUSTRIES, LLC, Randolph, NJ (US)

( * ) Notice: Subject to any disclaimer, the term of this patent is extended or adjusted under 35 U.S.C. 154(b) by 0 days.

(21) Appl. No.: 16/911,304

(22) Filed: Jun. 24, 2020

(65) Prior Publication Data

US 2020/0398175 A1 Dec. 24, 2020

Related U.S. Application Data

(60) Provisional application No. 62/865,679, filed on Jun. 24, 2019.

(51) Int. Cl.

| | |
|---|---|
| ***A63H 17/00*** | (2006.01) |
| ***A63H 33/04*** | (2006.01) |
| ***H01F 7/02*** | (2006.01) |

(52) U.S. Cl.

CPC ..... *A63H 33/046* (2013.01); *H01F 7/02* (2013.01)

(58) Field of Classification Search

CPC ..... A63H 33/046

See application file for complete search history.

(56) References Cited

U.S. PATENT DOCUMENTS

| | | | | |
|---|---|---|---|---|
| 2,970,388 A | | 2/1961 | Yonkers | |
| 3,195,266 A | | 7/1965 | Onanian | |
| 3,564,758 A | | 2/1971 | Willis | |
| 3,998,004 A | | 12/1976 | Ehrlich | |
| 4,265,002 A | | 5/1981 | Hosken | |
| 4,401,960 A | | 8/1983 | Uchikune et al. | |
| 4,726,588 A | | 2/1988 | Caprio | |
| 5,347,253 A | | 9/1994 | Ogikubo | |
| 5,520,396 A | | 5/1996 | Therrien | |
| 5,746,638 A | * | 5/1998 | Shiraishi | A63H 33/046 446/131 |

(Continued)

FOREIGN PATENT DOCUMENTS

| | | | | |
|---|---|---|---|---|
| CN | 108635885 A | * | 10/2018 | A63H 33/04 |
| JP | 2002159761 A | | 6/2002 | |

(Continued)

OTHER PUBLICATIONS

Lan Wenging, CN-108635885A machine translation, uploaded Sep. 21, 2021, Espacenet, 5 pages.*

(Continued)

*Primary Examiner* — Eugene L Kim
*Assistant Examiner* — Matthew B Stanczak
(74) *Attorney, Agent, or Firm* — Lewis Roca Rothgerber Christie LLP

(57) ABSTRACT

A magnetic toy construction block includes an inner shell and an outer shell which are arranged to form a module having a shell-within-a-shell construction. Disc-shaped magnets are rotatably received and maintained in pockets formed in the inner shell of the module. The inner shell is permanently housed within the outer shell such that the magnets lie in close proximity to its sidewalls and hence sidewalls of the module itself.

12 Claims, 3 Drawing Sheets

(56) References Cited

U.S. PATENT DOCUMENTS

| | | | | |
|---|---|---|---|---|
| 5,826,394 | A * | 10/1998 | Barton, Jr. | A63H 33/044 52/592.1 |
| 5,933,926 | A | 8/1999 | Reiter | |
| 6,566,992 | B1 | 5/2003 | Vicentelli | |
| 6,626,727 | B2 | 9/2003 | Balanchi | |
| 6,749,480 | B1 | 6/2004 | Hunts | |
| 6,846,216 | B1 | 1/2005 | Balanchi | |
| 6,963,261 | B2 | 11/2005 | Vicentelli | |
| 6,969,294 | B2 | 11/2005 | Vicentelli | |
| 7,066,778 | B2 | 6/2006 | Kretzschmar | |
| 7,089,627 | B2 | 8/2006 | Seidler | |
| 7,154,363 | B2 | 12/2006 | Hunts | |
| 7,160,170 | B2 | 1/2007 | Yoon | |
| 7,234,986 | B2 | 6/2007 | Kowalski et al. | |
| 7,276,270 | B2 | 10/2007 | Vicentelli | |
| 7,320,633 | B2 | 1/2008 | Park | |
| 7,364,487 | B2 | 4/2008 | Evans et al. | |
| 7,371,147 | B2 | 5/2008 | Tusacciu | |
| 7,413,493 | B2 | 8/2008 | Toht et al. | |
| 7,758,398 | B2 | 7/2010 | Park | |
| 7,833,078 | B2 | 11/2010 | Kretzschmar | |
| 7,887,056 | B2 * | 2/2011 | Tenorio | A63F 9/1208 273/156 |
| 7,955,155 | B2 | 6/2011 | Tremblay et al. | |
| 7,988,518 | B2 | 8/2011 | Kim et al. | |
| 8,016,635 | B2 | 9/2011 | Park | |
| 8,016,636 | B2 | 9/2011 | Park | |
| 8,070,550 | B2 | 12/2011 | Song et al. | |
| 8,100,735 | B2 | 1/2012 | Park | |
| 8,128,452 | B2 | 3/2012 | Klm et al. | |
| 8,292,687 | B2 | 10/2012 | Tremblay et al. | |
| 8,303,366 | B2 | 11/2012 | Tremblay et al. | |
| 8,382,548 | B2 * | 2/2013 | Maggiore | A63H 33/04 446/120 |
| 8,458,863 | B2 | 6/2013 | Hunts | |
| 8,475,225 | B2 | 7/2013 | Kretzschmar | |
| 8,529,311 | B2 | 9/2013 | Tremblay et al. | |
| 8,850,683 | B2 * | 10/2014 | Haughey | A63H 33/046 29/428 |
| 8,911,276 | B2 | 12/2014 | Kim et al. | |
| 9,022,829 | B2 | 5/2015 | Rosen et al. | |
| 9,457,288 | B2 | 10/2016 | Choi | |
| 9,782,687 | B2 * | 10/2017 | Bagley | A63H 33/046 |
| 9,814,998 | B2 | 11/2017 | Wei | |
| 9,821,244 | B1 * | 11/2017 | Whang | A63H 33/046 |
| 9,873,061 | B2 | 1/2018 | Cheung | |
| 9,873,062 | B2 * | 1/2018 | Purns | A63H 33/06 |
| 9,980,405 | B2 | 5/2018 | Hu et al. | |
| 10,080,977 | B2 | 9/2018 | Rosen et al. | |
| 10,328,355 | B2 | 6/2019 | Rosen et al. | |
| 10,518,190 | B2 | 12/2019 | Rosen et al. | |
| 10,722,809 | B1 * | 7/2020 | Park | A63H 33/046 |
| 2004/0043164 | A1 | 3/2004 | Vicentelli | |
| 2005/0124259 | A1 | 6/2005 | Tusacciu | |
| 2005/0159076 | A1 | 7/2005 | Kowalski et al. | |
| 2006/0014467 | A1 | 1/2006 | Tusacciu | |
| 2006/0178081 | A1 | 8/2006 | Daftari et al. | |
| 2008/0305708 | A1 * | 12/2008 | Toht | A63H 33/046 446/92 |
| 2009/0197500 | A1 * | 8/2009 | Song | A63H 33/046 446/92 |
| 2010/0022158 | A1 | 1/2010 | Kim | |
| 2010/0120322 | A1 | 5/2010 | Vicentelli | |
| 2012/0270465 | A1 * | 10/2012 | Park | A63H 33/046 446/129 |
| 2012/0309259 | A1 * | 12/2012 | Mak | A63H 33/046 446/92 |
| 2013/0111710 | A1 | 5/2013 | Hunts | |
| 2015/0065007 | A1 * | 3/2015 | Klepper | A63H 33/046 446/92 |
| 2015/0079870 | A1 * | 3/2015 | Howard | A63H 33/046 446/92 |
| 2015/0258461 | A1 | 9/2015 | Balanchi | |
| 2015/0262744 | A1 * | 9/2015 | Wei | H01F 7/02 335/306 |
| 2015/0325949 | A1 | 11/2015 | Wei | |
| 2016/0074766 | A1 | 3/2016 | Choi | |
| 2017/0216737 | A1 * | 8/2017 | Kiribuchi | A63H 33/046 |
| 2018/0056204 | A1 * | 3/2018 | Knudsen | A63H 33/046 |
| 2018/0126294 | A1 | 5/2018 | Rosen et al. | |
| 2018/0345156 | A1 | 12/2018 | Bornstein | |
| 2019/0201804 | A1 * | 7/2019 | Khalus | A63H 33/046 |
| 2019/0275440 | A1 * | 9/2019 | Eshet | A63H 33/084 |
| 2020/0161037 | A1 * | 5/2020 | Osipov | A63H 33/042 |
| 2020/0238190 | A1 * | 7/2020 | Tusacciu | A63H 33/046 |
| 2020/0346126 | A1 | 11/2020 | Bobrikov | |
| 2020/0353375 | A1 * | 11/2020 | Kogure | A63H 33/046 |

FOREIGN PATENT DOCUMENTS

| | | | |
|---|---|---|---|
| JP | 2003190663 | A | 7/2003 |
| WO | 1999060583 | A1 | 11/1999 |
| WO | 2002055168 | A1 | 7/2002 |
| WO | 2005068037 | A1 | 7/2005 |
| WO | 2006044613 | A2 | 4/2006 |
| WO | 2006057471 | A1 | 6/2006 |
| WO | 2006095940 | A1 | 9/2006 |
| WO | 2006112679 | A1 | 10/2006 |
| WO | 2009007829 | A2 | 1/2009 |
| WO | 2018129380 | A1 | 7/2018 |
| WO | 2018152361 | A1 | 8/2018 |

OTHER PUBLICATIONS

Smartmax General Instructions, Smart-Belgium, Brochure with copyright date of 2003-2015.

U.S. Appl. No. 29/594,094, filed Feb. 15, 2017, entitled "Toy Construction Elements".

Office Action dated Jul. 2, 2018, U.S. Appl. No. 15/863,590, filed Jan. 5, 2018 (U.S. Patent Publication No. 2018/0126294).

International Search Report and Written Opinion for PCT International Patent Application No. PCT/US2018/012667, dated Jun. 20, 2018.

International Search Report and Written Opinion for PCT International Patent Application No. PCT/US2018/018418, dated May 2, 2018.

International Preliminary Report on Patentability for International Patent Application No. PCT/US2018/018418, dated Aug. 29, 2019.

U.S. Appl. No. 16/914,133, filed Jun. 26, 2020, entitled "Magnetic Toy Construction Block with Ring-Type Magnet".

* cited by examiner

SHELL-WITHIN-A-SHELL MAGNETIC TOY CONSTRUCTION BLOCK

CROSS-REFERENCE TO RELATED APPLICATION(S)

This application claims priority to and the benefit of U.S. Provisional Application No. 62/865,679, filed on Jun. 24, 2019, the entire disclosure of which is incorporated herein by reference for all purposes.

FIELD

The present invention relates to magnetic modules, and more particularly to magnetic modules that may be used with other similar or dissimilar modules in a toy construction kit for building structures.

BACKGROUND

Magnetic construction kits have become a popular category for children's toys. These kits ordinarily include construction modules having magnets embedded therein that enable the modules to be connected together via magnetism. Using these modules, children are able to assemble many imaginative two-dimensional and three-dimensional shapes and structures, thereby imparting great enjoyment and entertainment to the children using them.

SUMMARY

The present invention relates to a toy construction module (i.e., block) having a shell-within-a-shell construction that permits a plurality of disc-shaped magnets to be housed within the module in a permanent and safe manner. More particularly, the magnets are rotatably maintained in pockets formed in an inner shell of the module. The inner shell is permanently positioned in the interior of an outer shell such that the magnets lie in close proximity to its sidewalls and hence sidewalls of the module. Because the magnets are rotatably maintained in their respective pockets, the positions of their poles relative to the sidewalls of the module are variable. Thus, when the module is placed adjacent another similar or dissimilar module, opposite poles of the magnets contained within the adjacent modules will automatically align to magnetically, but removably, attach the two modules together. When several modules are attached in the aforementioned manner, a user can arrange them into various different and interesting shapes and structures.

BRIEF DESCRIPTION OF THE DRAWINGS

For a more complete understanding of the present invention, reference is made to the following detailed description of various exemplary embodiments considered in conjunction with the accompanying drawings, in which.

DETAILED DESCRIPTION

Figure 1:
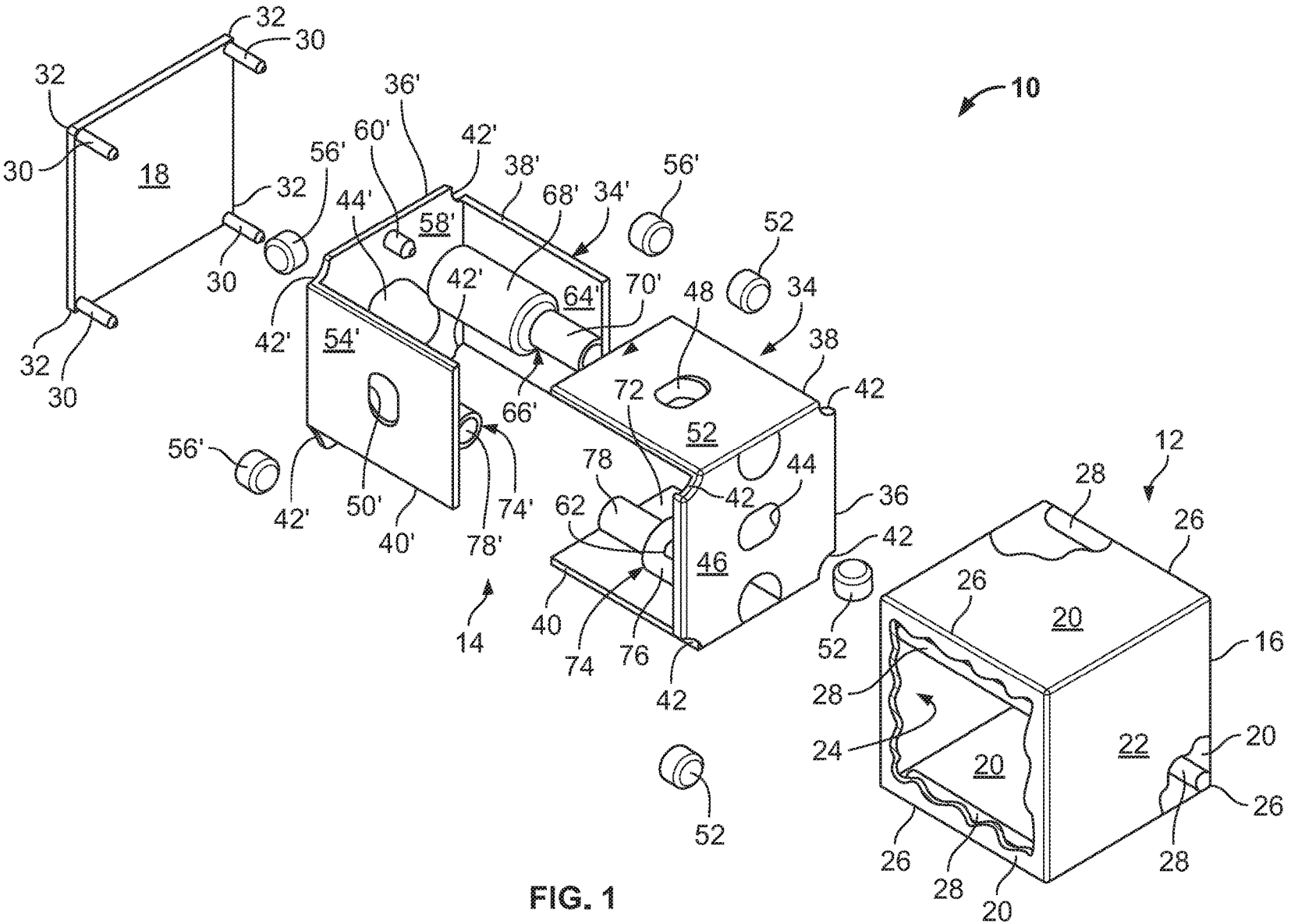
FIG. 1 is an exploded perspective view of a magnetic toy construction block representing one exemplary embodiment of the present invention, portions of certain elements of the block illustrated in FIG. 1 being broken away to facilitate consideration and discussion.
Figure 3:
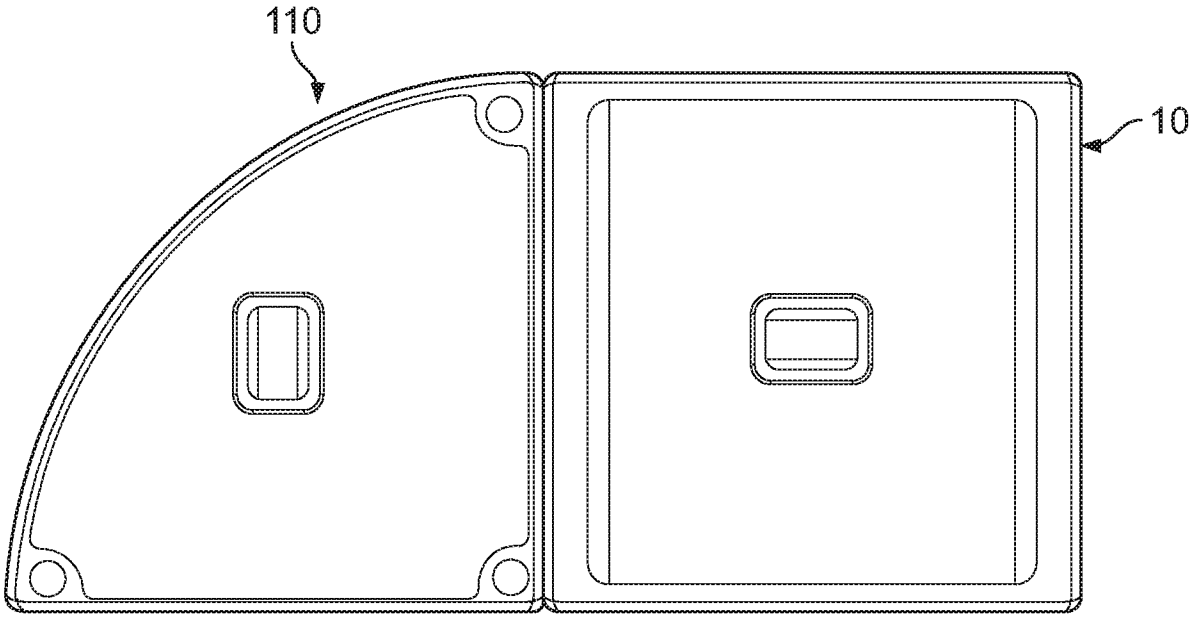
FIG. 3 is an elevational view showing the magnetic toy construction blocks of FIGS. 1 and 2 magnetically attached to each other to form an assembly of magnetic toy construction blocks in accordance with one particular application of the present invention.

With initial reference to FIG. 1, there is shown a magnetic toy construction block 10 having a shell-within-a-shell construction that is characterized by an outer shell 12 and an inner shell 14. Both the outer shell 12 and the inner shell 14 are made from a non-magnetic material, such as any suitable plastic, which can be opaque as shown, or, in the alternative, translucent or transparent (see FIG. 3).

Turning first to the outer shell 12, it is in the shape of a cube formed by a housing 16 and a lid 18. The housing 16 has four sidewalls 20 (two of which are broken out to facilitate consideration and discussion), a closed end 22 (which is also broken out to facilitate consideration and discussion) and an open end 24. The sidewalls 20 define four longitudinal edges 26 of the cube-shaped outer shell 12. The interior of each edge 26 includes an integrally formed, open-ended and elongated half-pipe 28 adapted to perform a socket-like function in that its open end receives a corresponding one of four mounting posts 30, each of which extends inwardly (i.e., toward the closed end 22 of the housing 16) from a respective corner 32 of the lid 18.

Like the outer shell 12, the inner shell 14 is in the shape of a cube, but one that is small enough to fit inside the outer shell 12. Unlike the outer shell 12, the inner shell 14 is formed by a pair of identical half-shells 34, 34'.

The half-shell 34, which is U-shaped, includes a base 36 and a pair of legs 38, 40. Cutouts 42 are provided in the four corners of the half-shell 34 (i.e., the corners formed where the base 36 meets with each of the legs 38, 40) for a purpose to be described hereinafter.

A blind end pocket 44 is formed in an outer face 46 of the base 36, while blind side pockets 48, 50 (side pocket 50 is not visible, but see side pocket 50' of the half-shell 34') are formed in outer faces 52, 54 (outer face 54 is not visible, but see outer face 54' of the half-shell 341, respectively, of their respective legs 38, 40. The end pocket 44 and the side pockets 48, 50 are sized and shaped so as to rotatably receive a corresponding one of three disc-shaped magnets 56, whose opposite magnetic poles (i.e., north pole and south pole) are arranged on diametrically opposed sides of the magnets 56.

The base 36 of the half-shell 34 has an inner face 58 (not visible, but see inner face 58' of the half-shell 34') through which the end pocket 44 protrudes. The inner face 58 of the base 36 also includes a pair of location pins 60, 62 (location pin 60 is not visible, but see location pin 60' of the half-shell 341, each of which extends inwardly (i.e., towards the half-shell 34') for a purpose to be described hereinafter.

The leg 38 of the half-shell 34 has an inner face 64 (not visible, but see inner face 64' of the half-shell 34') through which the side pocket 48 protrudes. The inner face 64 of the leg 38 includes a stepped sleeve 66 (not visible, but see sleeve 66' of the half-shell 34') having a larger diameter section 68 (not visible, but see larger diameter section 68' of the half-shell 34') proximate to the base 36 and a smaller diameter section 70 (not visible, but see smaller diameter section 70' of the half-shell 34') remote from the base 36. The larger diameter section 68 of the sleeve 66 is sized and shaped to receive the side pocket 48, while the smaller diameter section 70 is sized and shaped for a purpose to be described hereinafter.

In a fashion similar to that of the leg 38, the leg 40 of the half-shell 34 has an inner face 72 through which the side pocket 50 protrudes. The inner face 72 of the leg 40 includes a stepped sleeve 74 having a larger diameter section 76 proximate to the base 36 and smaller diameter section 78 remote from the base 36. The larger diameter section 76 of the sleeve 74 is sized and shaped to receive the side pocket 50, while the smaller diameter section 78 is sized and shaped for a purpose to be described hereinafter.

The half-shell 34', which is U-shaped like the half-shell 34, includes a base 36' and a pair of legs 38', 40'. Cutouts 42' are provided in the four corners of the half-shell 34' (i.e., the corners formed where the base 36' meets with each of the legs 38', 40') for a purpose to be described hereinafter.

A blind end pocket 44' is formed in an outer face 46' (not visible, but see outer face 46 of the half-shell 34) of the base 36', while blind side pockets 48', 50' (side pocket 48' is not visible, but see side pocket 48 of the half-shell 34) are formed in outer faces 52', 54' (outer face 52' is not visible, but see outer face 52 of the half-shell 34), respectively, of their respective legs 38', 40'. The end pocket 44' and the side pockets 48', 50' are sized and shaped so as to rotatably receive a corresponding one of three disc-shaped magnets 56', whose opposite magnetic poles (i.e., north pole and south pole) are arranged on diametrically opposed sides of the magnets 56'.

The base 36' of the half-shell 34' has an inner face 58' through which the end pocket 44' protrudes. The inner face 58' of the base 36' also includes a pair of location pins 60', 62' (location pin 62' is not visible, but see location pin 62 of the half-shell 34), each of which extends inwardly (i.e., towards the half-shell 34) for reception within the socket-like open end of the smaller diameter sections 70, 78, respectively, of their respective sleeves 66, 74 of the half-shell 34.

The leg 38' of the half-shell 34' has an inner face 64' through which the side pocket 48' protrudes. The inner face 64' of the leg 38' includes a stepped sleeve 66' having a larger diameter section 68' proximate to the base 36' and a smaller diameter section 70' remote from the base 36'. The larger diameter section 68' of the sleeve 66' is sized and shaped to receive the side pocket 48', while the smaller diameter section 70' has a socket-like open-end that is sized and shaped to receive the location pin 60 (not visible) on the base 36 of the half-shell 34.

In a fashion similar to that of the leg 38', the leg 40' of the half-shell 34' has an inner face 72' (not visible, but see inner face 72 of the half-shell 34) through which the side pocket 50' protrudes. The inner face 72' of the leg 40' includes a stepped sleeve 74' having a larger diameter section 76' (not visible, but see larger diameter section 76 of the half-shell 34) proximate to the base 36' and a smaller diameter section 78' remote from the base 36'. The larger diameter section 76' of the sleeve 74' is sized and shaped to receive the side pocket 50', while the smaller diameter section 78' has a socket-like open end that is sized and shaped to receive the location pin 62 on the base 36 of the half-shell 34.

To assemble the inner shell 14 of the magnetic toy construction block 10, the half-shells 34, 34' would be fitted together such that:

- the location pins 60', 62' of the half-shell 34' are received within the smaller diameter sections 70, 78, respectively, of the half-shell 34 in the manner described above; and
- the location pins 60, 62 of the half-shell 34 are received within the smaller diameter sections 70', 78', respectively, of the half-shell 34' in the manner described above.

Before or after the assembly of the inner shell 14, the magnets 56 would be applied to the end pocket 44 and the side pockets 48, 50 of the half-shell 34, while the magnets 56' are applied to the end pocket 44' and the side pockets 48', 50' of the half-shell 34'. The half-shells 34, 34' can be permanently joined together by, for instance, ultrasonic welding, gluing, etc., or they can be left loosely attached to one another.

Once assembled as described above, the inner shell 14 would be inserted into the housing 16 of the outer shell 12 through the open end 24 thereof, the cutouts 42, 42' permitting the inner shell 14 to pass over the half-pipes 28 extending along the interiors of the edges 26 of the housing 16. The lid 18 would then be applied to the housing 16 such that:

- the mounting posts 30 on the lid 18 are inserted into the socket-like ends of their respective half-pipes 28 in the housing 16 through the cutouts 42, and/or the cutouts 42' in the assembled inner shell 14; and
- the lid 18 closes off the open end 24 of the housing 16.

The lid 18 would then be permanently joined to the housing 16 by, for instance, ultrasonic welding, gluing, etc. The result of such a shell-within-a-shell construction is that the magnets 56, 56' would be rotatably supported by the inner shell 14 in close proximity to the outer shell 12. As a further result of this construction, the magnets 56, 56' cannot be inadvertently or accidentally removed from the magnetic toy construction block 10 by a user or another person. In other words, the magnets 56, 56' are effectively entombed within the magnetic toy construction block 10 for safety purposes and otherwise.

Because the magnets 56 are rotatably maintained in their respective pockets 44, 48 and 50 of the half-shell 34 and the magnets 56' are rotatably maintained in their respective pockets 44', 48' and 50' of the half-shell 34', the positions of their poles relative to the sidewalls 20 of the outer shell 12 are variable. Thus, when the magnetic toy construction block 10 is placed adjacent another similar magnetic toy construction block (see, for example, FIG. 3), the opposite poles of the magnets contained in the adjacent blocks will automatically align to magnetically, but removably, attach the two blocks together. When several such blocks are attached in this manner, a user can arrange the blocks into various different and interesting shapes and structures.

Figure 2:
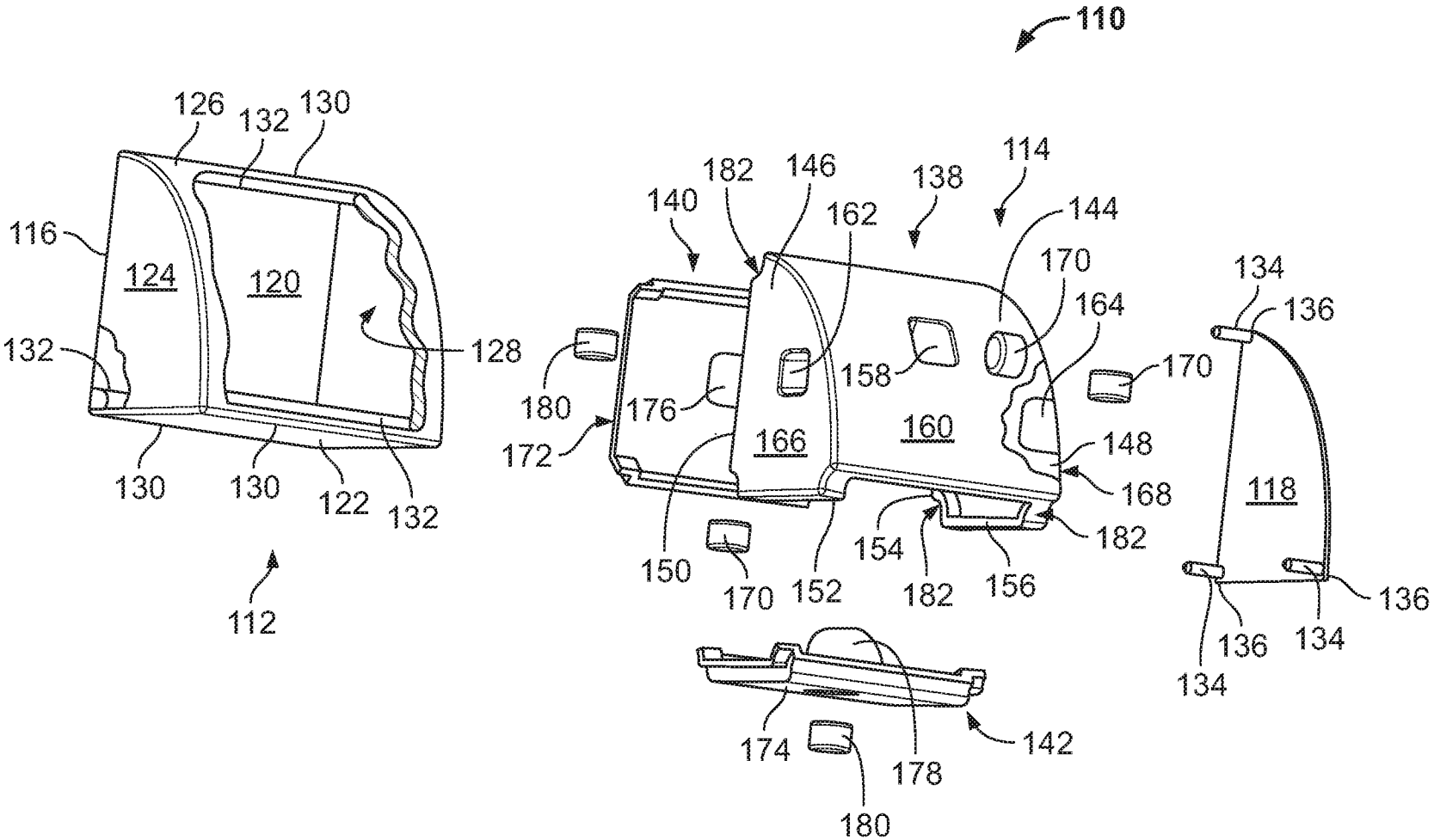
FIG. 2 is an exploded perspective view of a magnetic toy construction block representing another exemplary embodiment of the present invention, portions of certain elements of the block illustrated in FIG. 2 being broken away to facilitate consideration and discussion.

With reference now to FIG. 2, there is shown a magnetic toy construction block 110, which, like the magnetic toy construction block 10 of FIG. 1, has a shell-within-a-shell construction characterized by an outer shell 112 and an inner shell 114. Both the outer shell 112 and the inner shell 114 are made from a non-magnetic material, such as any suitable plastic, which can be opaque, translucent or transparent.

Turning first to the outer shell 112, it is in the shape of a quarter cylinder (i.e., a five-sided, three-dimensional shape characterized by one arcuate wall and four planar walls) formed by a housing 116 and a lid 118. The housing 116 has two sidewalls 120, 122 arranged at right angles relative to each other, a closed end 124, an arcuate wall 126 and an open end 128 having three longitudinal edges 130. The interior of each edge 130 includes an integrally formed, open-ended and elongated half-pipe 132 adapted to perform a socket-like function in that its open end receives a corresponding one of three mounting posts 134, each of which extends inwardly (i.e., toward the closed end face 124 of the housing 116) from a respective corner 136 of the lid 118.

Like the outer shell 112, the inner shell 114 is in the shape of a quarter cylinder, but one that is small enough to fit inside the outer shell 112. Unlike the outer shell 112, which has a two-part construction, the inner shell 114 has a three-part construction characterized by a canopy-like member 138 and a pair of planar covers 140, 142. The canopy-like member 138 has a curved wall 144 and a pair of parallel sidewalls 146, 148 arranged at opposite sides of the inner shell 114 where each of the sidewalls 146, 148 is attached to the canopy-like member 138. The sidewall 146 has a pair of mounting rails 150, 152 for purposes to be described hereinafter. In a similar fashion, the sidewall 148 has a pair of mounting rails 154, 156 for purposes to be described hereinafter.

With reference to the canopy-like member 138 of the inner shell 114, a blind end pocket 158 is formed in an outer face 160 of the curved wall 144, while blind side pockets 162, 164 are formed in outer faces 166, 168, respectively, of their respective sidewalls 146, 148. The end pocket 158 and the side pockets 162, 164 are sized and shaped so as to rotatably receive a corresponding one of three disc-shaped magnets 170, whose opposite magnetic poles (i.e., north pole and south pole) are arranged on diametrically opposed sides of the magnets 170.

Referring now to the covers 140, 142 of the inner shell 114, they have outer faces 172, 174, respectively, which are provided with blind pockets 176, 178, respectively. The pockets 176, 178 are sized and shaped so as to rotatably receive a corresponding one of two disc-shaped magnets 180, whose opposite magnetic poles (i.e., north pole and south pole) are arranged on diametrically opposed sides of the magnets 180.

To assemble the inner shell 114 of the magnetic toy construction block 110, the covers 140, 142 would be fitted to the canopy-like member 138 such that:

the cover 140 is joined to the mounting rails 150, 154 of the sidewalls 146, 148, respectively, of the canopy-like member 138; and the cover 142 is joined to the mounting rails 152, 156 of the sidewalls 146, 148, respectively, of the canopy-like member 138.

Before or after the assembly of the inner shell 114, the magnets 170 would be applied to the end pocket 158 and the side pockets 162, 164 of the canopy-like member 138, while the magnets 180 are applied to the pockets 176, 178 of the covers 140, 142, respectively. Before or after the application of the magnets 170, 180, the covers 140, 142 would be permanently joined to the canopy-like member 138 by, for instance, ultrasonic welding, gluing, etc., or they could be left loosely attached to the canopy-like member 138.

Once assembled as described above, the inner shell 114 would be provided with three longitudinally extending recesses 182 adapted to allow the inner shell 114 to be inserted into the housing 116 of the outer shell 112 through the open end 128 thereof. More specifically, the recesses 182 accommodate the passage of the elongated half-pipes 132 arranged along the interiors of the three edges 130 of the outer shell 112. The lid 118 would then be applied to the housing 116 such that:

the mounting posts 134 on the lid 118 are inserted into the socket-like ends of their respective half-pipes 132 in the housing 116 through the recesses 182 in the assembled inner shell 114; and the lid 118 closes off the open end 128 of the housing 116.

The lid 118 would then be permanently joined to the housing 116 by, for instance, ultrasonic welding, gluing, etc. The result of such a shell-within-a-shell construction is that the magnets 170, 180 would be rotatably supported by the inner shell 114 in close proximity to the outer shell 112. As a further result of this construction, the magnets 170, 180 cannot be inadvertently or accidently removed from the magnetic toy construction block 110 by a user or another person. In other words, the magnets 170, 180 are effectively entombed within the magnetic toy construction block 110 for safety purposes and otherwise.

Because the magnets 170, 180 are permitted to rotate within the magnetic toy construction block 110, the positions of their poles relative to the magnetic toy construction block 110 are also variable. Thus, when the magnetic toy construction block 110 is placed adjacent another similar or dissimilar magnetic toy construction block, such as the magnetic toy construction block 10 of FIG. 1 (see FIG. 3), the opposite poles of the magnets contained in the adjacent blocks will automatically align to magnetically, but removably, attach the blocks 10, 110 together. When several such blocks are attached in this manner, a user can arrange the blocks into various different and interesting shapes and structures.

It will be understood that the embodiments described hereinabove are merely exemplary and that a person skilled in the art may make many variations and modifications without departing from the spirit and scope of the present invention. For instance, the above-described shell-within-a-shell construction of the blocks 10, 110 may lead to applications and/or uses outside the toy field.

We claim:

1. A magnetic construction block, comprising:

an outer shell having a multi-part construction and comprising a first plurality of parts joined together to form a first six-sided polyhedron, including a first plurality of faces;

a plurality of disc-shaped magnets;

an inner shell, cooperating with said outer shell to effectively entomb said plurality of disc-shaped magnets within said magnetic construction block, said inner shell having a multi-part construction wherein said inner shell includes a second plurality of parts joined permanently together, including a pair of U-shaped half-shells configured to form a second six-sided polyhedron, a first half-shell of said pair of U-shaped half shells comprising a first base having a first face of a second plurality of faces, a first leg extending from one side of said base having a second face of said second plurality of faces, and a second leg having a third face of said second plurality of faces and extending from an opposite side of said first base in the same direction as said first leg and substantially parallel thereto, a second half-shell of said pair of U-shaped half shells comprising a second base having a fourth face of said second plurality of faces, a third leg extending from one side of said second base having a fifth face of said second plurality of faces, and a fourth leg having a sixth face of said second plurality of faces and extending from an opposite side of said second base in the same direction as said third leg and substantially parallel thereto, said second plurality of parts defining an interior delimited by said second plurality of faces, wherein each part of said second plurality of parts includes at least one face of said second plurality of faces, each face of said second plurality of faces of said inner shell being juxtaposed relative to a corresponding face of said first plurality of faces of said outer shell, wherein each face of said second plurality of faces of said inner shell includes a receptacle having a corresponding blind pocket having an open end formed in a corresponding one of said second plurality of faces of said inner shell and a closed end positioned in said interior of said inner shell, said receptacle extending into said interior of said inner shell and rotatably receiving a corresponding one of said plurality of disc-shaped magnets, such that each of said first, second, third, fourth, fifth and sixth faces of said second plurality of faces has a respective blind pocket of said plurality of blind pockets containing a corresponding one of said plurality of disc-shaped magnets, respectively, each magnet of said plurality of disc-shaped magnets being maintained in its corresponding receptacle by a corresponding juxtaposed face of said outer shell without inhibiting its rotatability;

a first sleeve positioned on said second face of said one half-shell within said interior of said inner shell and configured to receive a respective one of said plurality of blind pockets and hence a respective one of said plurality of disc-shaped magnets; and a second sleeve positioned on said third face of said one half-shell within said interior of said inner shell and configured to receive a respective one of said plurality of blind pockets and hence a respective one of said plurality of disc-shaped magnets.

2. A magnetic construction block according to claim 1, wherein each magnet of said plurality of disc-shaped magnets has a pair of diametrically-opposed poles.

3. A magnetic construction block according to claim 2, wherein the positions of said poles of a corresponding one of said disc-shaped magnets is variable relative to said inner and outer shells responsive to the rotation of said corresponding one of said disc-shaped magnets.

4. A magnetic construction block according to claim 3, wherein said inner and outer shells are made from a non-magnetic material.

5. A magnetic construction block according to claim 4, wherein said non-magnetic material is opaque.

6. A magnetic construction block according to claim 4, wherein said non-magnetic material is translucent.

7. A magnetic construction block according to claim 4, wherein said non-magnetic material is transparent.

8. A magnetic construction block according to claim 1, wherein said inner and outer shells are in the shape of a cube.

9. The magnetic construction block of claim 1, wherein said fifth face of said second half-shell includes a third sleeve positioned within said interior of said inner shell and configured to receive a respective one of said plurality of blind pockets and hence a respective one of said plurality of disc-shaped magnets; and wherein said sixth face of said second half-shell includes a fourth sleeve positioned within said interior of said inner shell and configured to receive a respective one of said plurality of blind pockets and hence a respective one of said plurality of disc-shaped magnets.

10. The magnetic construction block of claim 9, wherein said first sleeve includes a first socket configured to receive a first pin provided on said second half-shell; wherein said second sleeve includes a second socket configured to receive a second pin provided on said second half-shell; wherein said third sleeve includes a third socket configured to receive a third pin provided on said first half-shell; and wherein said fourth sleeve includes a fourth socket configured to receive a fourth pin provided on said first half-shell.

11. The magnetic construction block of claim 10, wherein said first, second, third and fourth sleeves cooperate with said first, second, third and fourth pins to join said first half-shell and said second half-shell.

12. The magnetic construction block of claim 11, wherein said open end of each blind pocket is closed by a corresponding, juxtaposed face of said first plurality of faces of said outer shell.

* * * * *